US006383007B1

(12) United States Patent
Lin et al.

(10) Patent No.: US 6,383,007 B1
(45) Date of Patent: May 7, 2002

(54) ZIF SOCKET ASSEMBLY WITH IMPROVED PROTECTOR

(75) Inventors: Cheng-Hong Lin; Hao-Yun Ma, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/940,330

(22) Filed: Aug. 27, 2001

(51) Int. Cl.[7] ..... H01R 4/50; H01R 13/625
(52) U.S. Cl. ..... 439/342
(58) Field of Search ..... 439/342, 259

(56) References Cited

U.S. PATENT DOCUMENTS 5,057,031 A * 10/1991 Sinclair ..... 439/261
5,730,615 A * 3/1998 Lai et al. ..... 439/342

* cited by examiner

*Primary Examiner*—Brian Sircus
*Assistant Examiner*—Javaid Nasri
(74) *Attorney, Agent, or Firm*—Wei Te Chung

(57) ABSTRACT

A ZIF socket assembly used with an integrated circuit package (6) comprises a ZIF socket (5) and a protector (7). The socket comprises a base (51) and a sliding cover (53). The base comprises a recess (514) at an end thereof. The sliding cover is moveably assembled on the base for mounting the package and comprises a slot (533) in alignment with the recess. The protector is placed upon the package and comprises a number of legs (71) extending downwardly for pressing against edges of the package. A contacting portion (73) extends outwardly from an edge of the protector. An actuating tool is inserted into the recess through the slot and drives the cover, the package and the protector to move with respect to the base, thereby achieving an electrical connection between the package and the socket.

1 Claim, 6 Drawing Sheets

ZIF SOCKET ASSEMBLY WITH IMPROVED PROTECTOR

BACKGROUND OF THE INVENTION

1. Field of the Invention

The present invention relates to a ZIF (Zero Insertion Force) socket assembly, and particularly to a ZIF socket assembly which has a sliding cover moveable on a base with an actuating tool without causing damage to integrated circuit package. This application relates to the applications Ser No. 09/893,857 filed Jun. 27, 2001 and Ser. No. 09/909, 511 filed Aug. 3, 2001.

2. Description of Related Art

ZIF socket is widely used for connecting an integrated circuit package with a printed circuit board. A conventional ZIF socket includes a base, a sliding cover moveably assembled on the base, and a cam lever rotatably sandwiched between the base and the sliding cover. The cam lever is rotated by manipulation and drives the sliding cover to move on the base, thereby achieving a ZIF connection. Recently, for consideration of the miniaturization of all kinds of devices, particularly of the portable computer, the ZIF socket has to reduce its size or height. The conventional ZIF socket operated by a cam lever, which is for example disclosed in U.S. Pat. No. 5,057,031, cannot meet the trend of miniaturization. U.S. Pat. No. 5,730,615 discloses a low-profile ZIF socket of which a sliding cover is operated by an actuating tool and moves on a base. However, for ensuring enough movement of an integrated circuit package mounted on the sliding cover, the actuating tool will press against the integrated circuit package directly and may damage the encapsulating ceramic material of the integrated circuit package. Therefore, in actual application, a protector is provided upon the integrated circuit package for preventing the integrated circuit package from being subjected to force directly.

Referring to FIGS. 5 and 6, a ZIF socket assembly for connecting an integrated circuit package 2 with a mating printed circuit board (not shown) comprises a ZIF socket 1 and a protector 3. The ZIF socket 1 comprises a base 10 and a sliding cover 11 moveably assembled on the base 10. The base 10 comprises a recess 101 at an end thereof. The sliding cover 11 defines a slot 111 in vertical alignment with the recess 101 of the base 10. The integrated circuit package 2 is mounted on the sliding cover 11. The protector 3 is placed upon the integrated circuit package 2 and comprises a plurality of legs 31 extending downwardly from each edge thereof and pressing against the integrated circuit package 2. As is clearly shown in FIG. 6, in manipulation, an actuating tool 4 is inserted into the recess 101 through the slot 111 and rotated to drive the sliding cover 11 and the integrated circuit package 2 to move with respect to the base 10, thereby achieving an electrical connection between pins 20 of the package 2 and terminals 100 of the socket 1.

However, when the actuating tool 4 is rotated to a position shown in FIG. 6, the actuating tool 4 will exert a large force F on the protector 3, of which a downward component P will press the package 2 through the protector 3 and may damage the package 2.

Hence, an improved protector arrangement is required to overcome the disadvantages of the conventional ZIF socket assembly.

SUMMARY OF THE INVENTION

Accordingly, the object of the present invention is to provide a ZIF socket assembly with an improved protector which can avoid exerting a downward force on a package when an actuating tool drives the package to move with respect to a base of the socket.

In order to achieve the object set forth, a ZIF socket assembly for use with an integrated circuit package comprises a socket and a protector. The socket comprises a base, a plurality of terminals received in the base, and a sliding cover. The base comprises a plurality of receiving passageways for receiving corresponding terminals and a lower flange extending outwardly from an end thereof. The lower flange defines a recess in an upper face thereof. The sliding cover is moveably assembled on the base for receiving the package and comprises a plurality of through holes in vertical alignment with corresponding receiving passageways. An upper flange extends outwardly from an end of the cover and defines a slot in vertical alignment with the recess of the base. The protector is placed upon the package and comprises a plurality of legs extending downwardly for contacting with edges of the package. A contacting portion extends outwardly and upwardly from an edge of the protector for reducing a force exerted on the package by the protector. In another embodiment in accordance with the present invention, an outwardly extending contacting portion is formed on an edge of the protector to perform the same function.

Other objects, advantages and novel features of the invention will become more apparent from the following detailed description when taken in conjunction with the accompanying drawings.

DETAILED DESCRIPTION OF THE INVENTION

Figure 1:
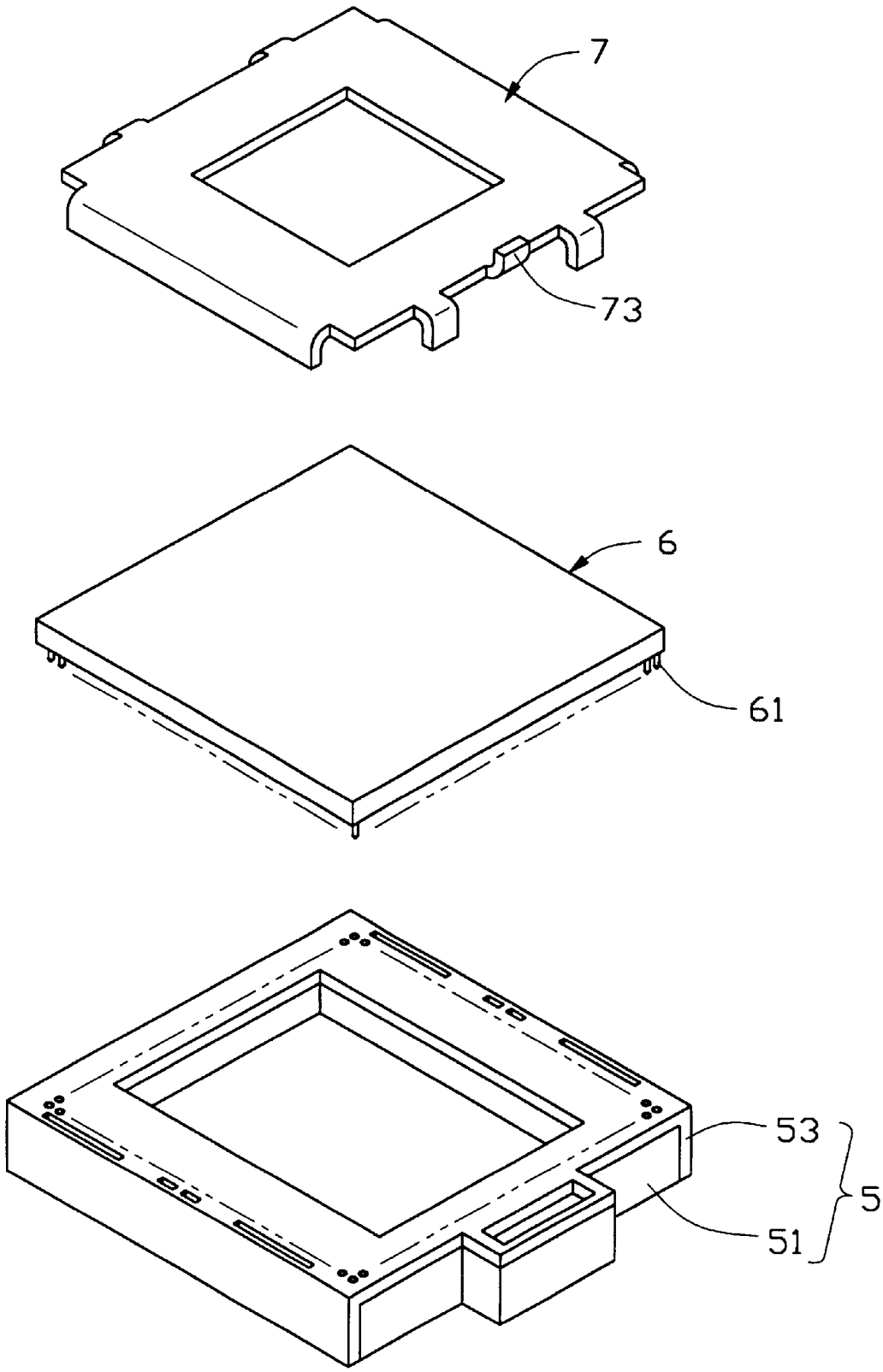
FIG. 1 is a perspective, exploded view of a ZIF socket assembly of a first embodiment of the present invention and an integrated circuit package.
Figure 3:
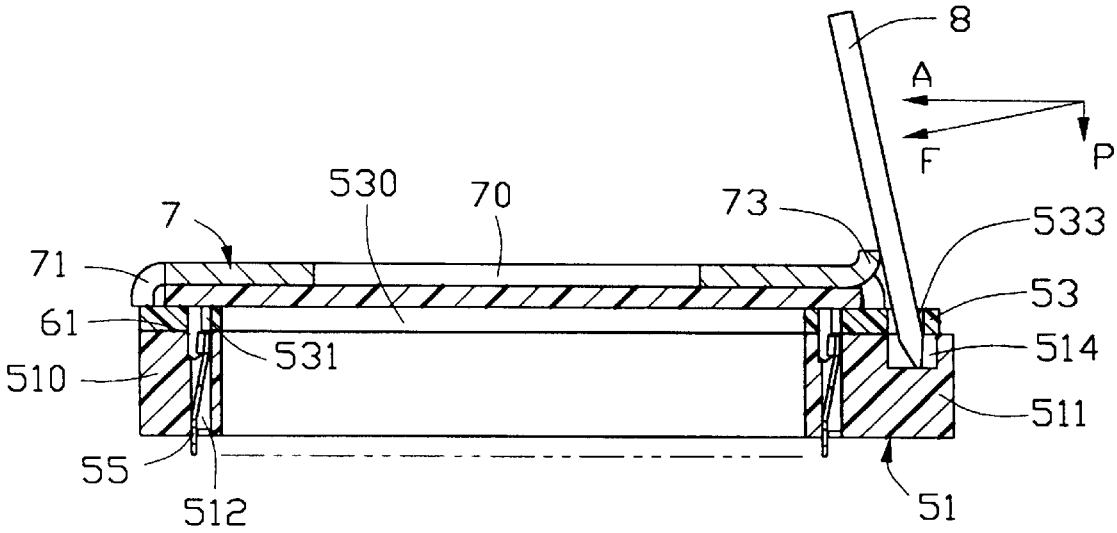
FIG. 3 is a cross-sectional view of the ZIF socket assembly illustrating an actuating tool driving a protector, the package and a sliding cover of the socket to move with respect to a base of the socket.

Referring to FIGS. 1 and 3, a ZIF socket assembly in accordance with the present invention comprises a ZIF socket 5 and a protector 7. The ZIF socket 5 comprises a base 51, a sliding cover 53 moveably assembled on the base 51, and a plurality of terminals 55 received in the base 51.

Figure 2:
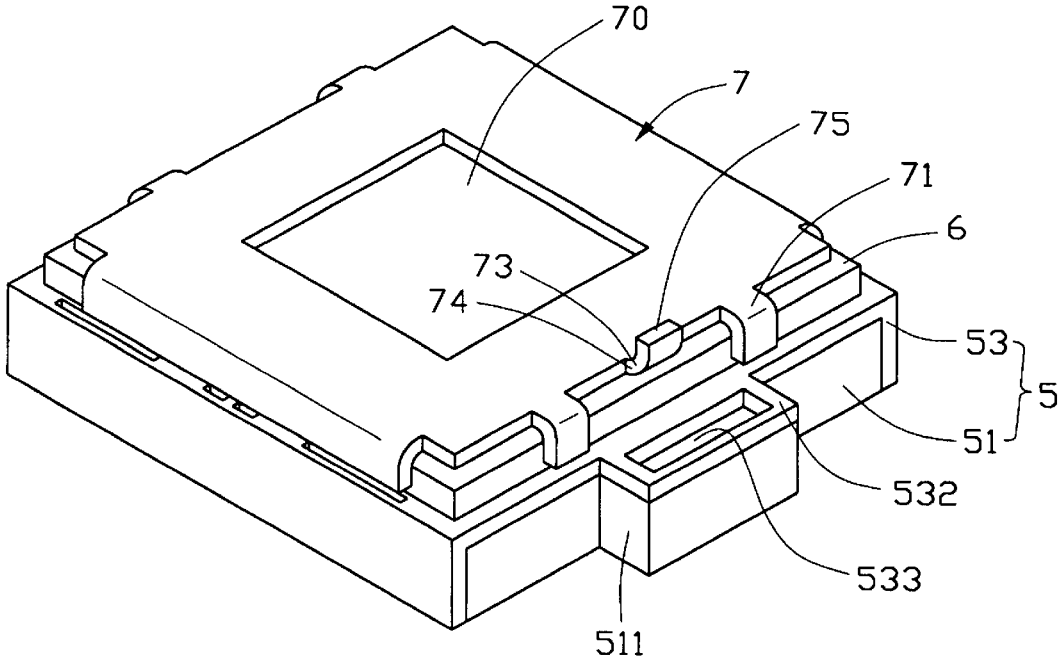
FIG. 2 is a perspective view of the assembled ZIF socket assembly holding the package.

Referring to FIGS. 2 and 3, the base 51 comprises a lower rectangular member 510 and a lower flange 511 extending outwardly from an end of the lower rectangular member 510. The lower rectangular member 510 defines a plurality of spaced apart receiving passageways 512 extending vertically through the base 51 for receiving corresponding terminals 55. The lower flange 511 defines a recess 514 in an upper face thereof.

The sliding cover 53 comprises an upper rectangular member 530 and an upper flange 532 extending outwardly from an end of the upper rectangular member 530. The upper rectangular member 530 defines a plurality of through holes 531 in alignment with corresponding receiving passageways 512 of the base 51 for receiving corresponding pins 61 of a mating integrated circuit package 6 mounted on the sliding cover 53. The upper flange 532 defines a rectangular slot 533 in vertical alignment with the recess 514 of the base 51.

The protector 7 is assembled on the package 6 and comprises a square opening 70 in the middle thereof and a plurality of legs 71 extending downwardly from each edge thereof. A contacting portion 73 extends upwardly from an edge of the protector 7. The contacting portion 73 includes an outwardly extending section 74 and an upwardly extending section 75.

In assembly, referring to FIGS. 2 and 3, the terminals 55 are placed in the receiving passageways 512 of the base 51 and the sliding cover 53 is moveably assembled on the base 51 with the through holes 531 in vertical alignment with corresponding receiving passageways 512. The package 6 is then placed on the sliding cover 53 with the pins 61 received in corresponding receiving passageways 512 through corresponding through holes 531. The protector 7 is finally placed on the package 6 with the legs 71 pressing against edges of the package 6 and with the contacting portion 73 facing the flanges 511, 532.

In manipulation, an actuating tool 8 is inserted into the recess 514 of the base 51 through the slot 533 of the sliding cover 53. Successively, the actuating tool 8 is rotated from a substantially vertical position to a declining position. A horizontal component A of on actuating force exerted on the protector 7 drives the sliding cover 53, the protector 7 and the integrated circuit package 6 to move with respect to the base 51. Therefore, an electrical connection between the pins 61 of the package 6 and the terminals 55 of the socket 5 is achieved. Since the actuating tool 8 is biased against the outwardly extending contacting portion 73 of the protector 7, the actuating tool 8 is inclined at a small angle, whereby a downward component P of the force F is significantly smaller than that of the related design. Thus, the package 6 is prevented from damage.

Figure 4:
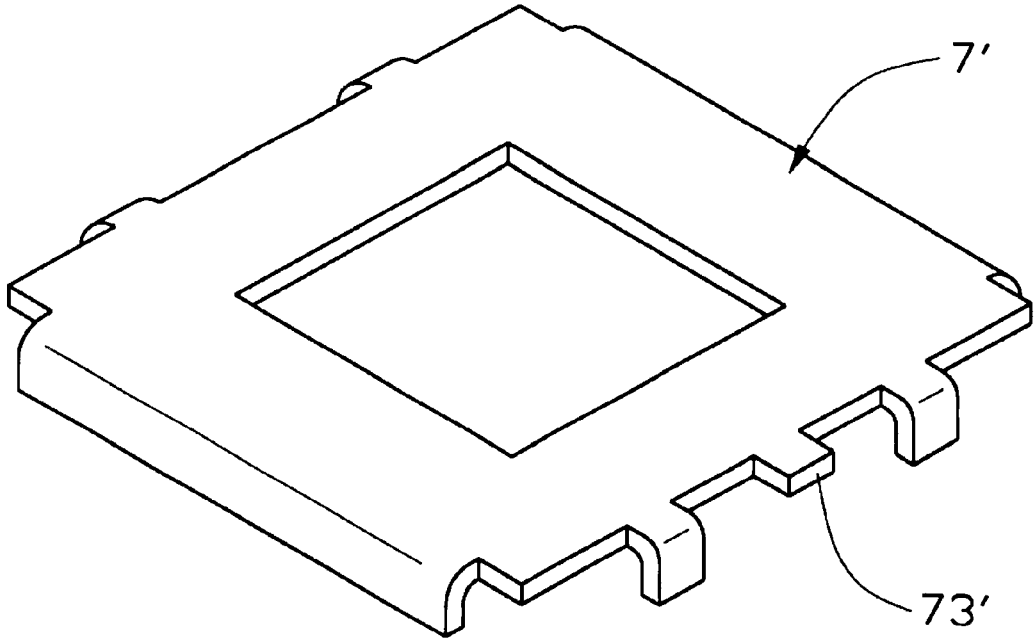
FIG. 4 is a perspective view of a protector in accordance with a second embodiment of the present invention.
Figure 5:
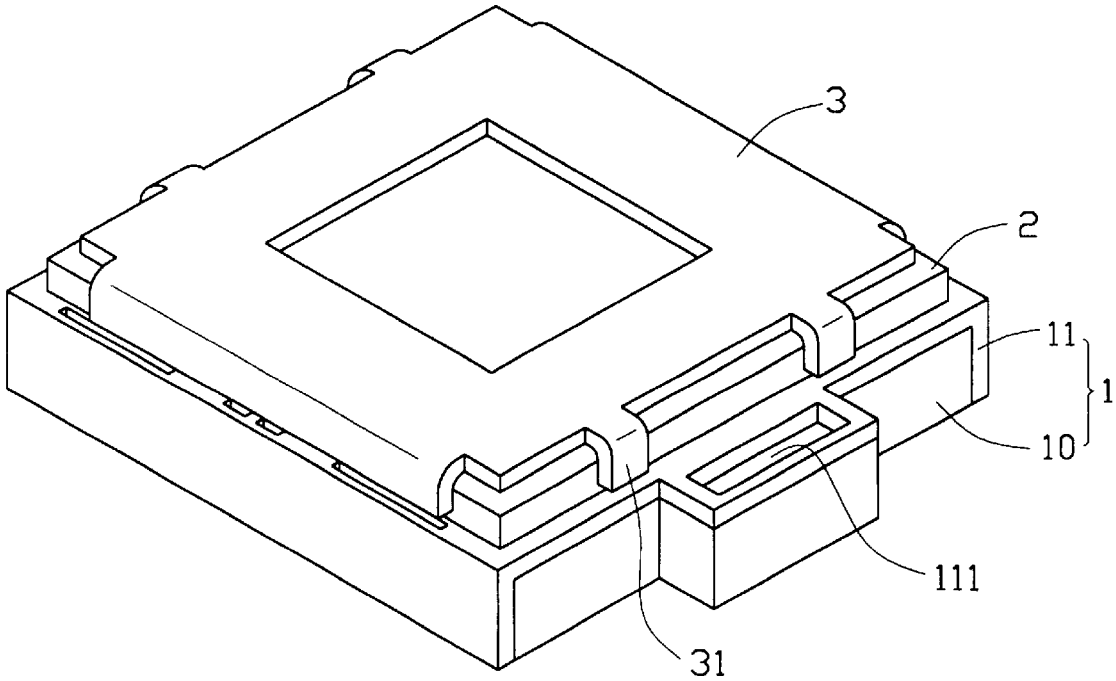
FIG. 5 (PRIOR ART)
FIG. 5 is a perspective view of an assembled view of a conventional ZIF socket assembly.
Figure 6:
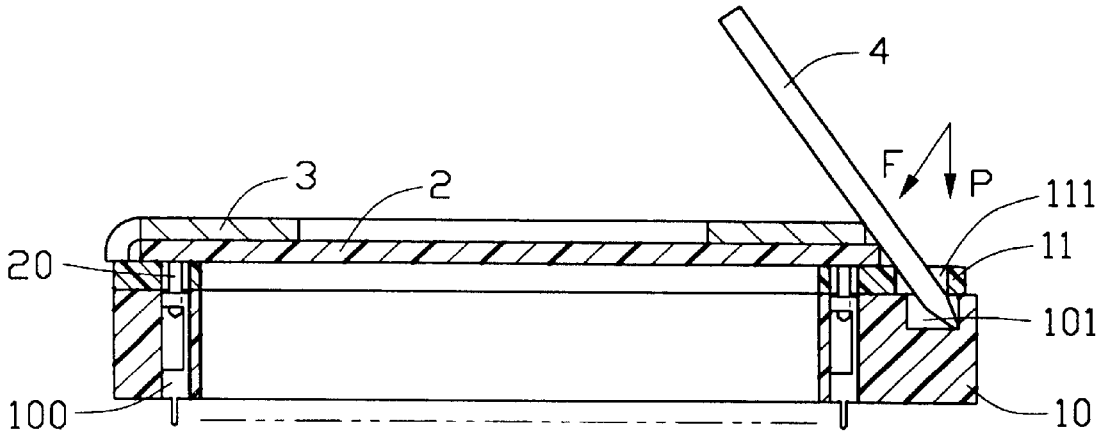
FIG. 6 (PRIOR ART)
FIG. 6 is a cross-sectional view similar to FIG. 3 but showing operation of the related socket of FIG. 5.

Referring to FIG. 4, a protector 7' of another embodiment of the present invention is shown. The protector 7' is similar to the protector 7 of the first embodiment and has an outwardly extending contact portion 73' for performing the same function as the protector 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ZIF (Zero Insertion Force) socket assembly for use with an integrated circuit package, comprising:

a ZIF socket comprising a base defining a plurality of receiving passageways and a recess at an end thereof, a plurality of terminals received in corresponding receiving passageways of the base, and a sliding cover moveably assembled on the base for mounting the package and comprising a plurality of through holes in vertical alignment with corresponding receiving passageways and a slot in vertical alignment with the recess of the base; and a protector placed upon the package and comprising a plurality of legs extending downwardly for pressing against edges of the package and a contacting portion extending outwardly from an edge thereof, the contacting portion being adapted to be abutted against by an actuating tool inserted through the recess and the slot to actuate the package and the sliding cover to move along the base; wherein the protector defines a rectangular opening in the middle thereof; wherein both the legs and the contacting portion extend outwardly along substantially a same edge of said protector; wherein said edge is one of edges defined by said protector while being an only one confronting said recess and slot.

* * * * *